US007097533B2

(12) United States Patent
Szekely

(10) Patent No.: US 7,097,533 B2
(45) **Date of Patent: *Aug. 29, 2006**

(54) INJECTION MOLDED NOISE MAKING DEVICE

(76) Inventor: Michael Szekely, 5801 NW. 31st St., Oklahoma City, OK (US) 73122

( * ) Notice: Subject to any disclaimer, the term of this patent is extended or adjusted under 35 U.S.C. 154(b) by 0 days.

This patent is subject to a terminal disclaimer.

(21) Appl. No.: 11/104,256

(22) Filed: Apr. 11, 2005

(65) Prior Publication Data

US 2005/0176343 A1 Aug. 11, 2005

Related U.S. Application Data

(63) Continuation-in-part of application No. 10/630,133, filed on Jul. 30, 2003, now Pat. No. 6,881,121.

(51) Int. Cl.
*A63H 5/00* (2006.01)

(52) U.S. Cl. ..... 446/213; 446/397

(58) Field of Classification Search ..... 446/397, 446/180, 188, 202, 204–206, 213, 216, 416, 446/207–209; 84/330, 350
See application file for complete search history.

(56) References Cited

U.S. PATENT DOCUMENTS 4,997,402 A * 3/1991 Blease ..... 446/202
5,234,368 A * 8/1993 Carraway ..... 446/202
6,881,121 B1 * 4/2005 Szekely ..... 446/213

* cited by examiner

*Primary Examiner*—Eugene Kim
*Assistant Examiner*—Alyssa Lowen
(74) *Attorney, Agent, or Firm*—LaRiviere, Grubman & Payne, LLP

(57) ABSTRACT

The invention provides a noise-maker having an injection molded single piece body, a membrane and a retaining ring. The injection molded single piece body includes a generally cylindrical central tube and a generally cylindrical pressure tube which defines a pressure chamber. The retaining ring has an inner diameter adapted to fit over the outer surface of the central tube such that the membrane is secured to and stretched across the central tube first end and the pressure tube first end. Sound is created when air or other gas is forced into pressure chamber. The air must pass through the pressure chamber around a pressure tube first end and out the discharge end of central tube. By forcing air into the pressure chamber, membrane vibrates producing a loud sound.

14 Claims, 4 Drawing Sheets

INJECTION MOLDED NOISE MAKING DEVICE

REFERENCE TO PENDING APPLICATIONS

This application is a continuation-in-part of U.S. patent application Ser. No. 10/630,133 filed on Jul. 30, 2003 now U.S. Pat. No. 6,881,121 entitled INJECTION MOLDED NOISE-MAKER.

REFERENCE TO MICROFICHE APPENDIX

This application is not referenced in any microfiche appendix.

FIELD OF THE INVENTION

The present invention is generally directed toward the production of a noise making device, more particularly the production of noise making device by an injection-mold process.

BACKGROUND OF THE INVENTION

Organized team sports, including football, basketball, baseball, and soccer, have a significant role in modern culture, and sporting events are attended by millions of people each year. Fans who attend sporting events typically do so not just as passive observers, but as participants in the sense of cheering for and encouraging their chosen teams. In addition to verbal cheers and applause, many fans use noise making devices to express their excitement and encouragement. It is generally considered that coordinated cheers are particularly effective for encouraging the players and encouraging other fans.

Many fans wish to express their support and encourage their chosen teams with noisemakers of one form or another. While prior art devices do produce noises, the sounds are poorly projected toward the field and can typically lack aesthetic qualities.

While many noise-makers have been made in recent years, these noisemakers typically have drawbacks involving the cost of manufacture. These noisemakers are made from the combination of numerous parts, causing an increased cost thereof. Accordingly, such noisemakers have not been considered economical to manufacture.

Thus, there is a need to create an aesthetically pleasing but cost efficient noisemaker which can produce a desired level of sound.

BRIEF SUMMARY OF THE INVENTION

The present invention satisfies the need discussed above. The present invention is generally directed toward the production of a noise maker, more particularly the production of noisemaker by an injection-mold process.

The invention provides for a single injection molded structural body for use with a noise-maker. In contrast to multi-component prior art noise making devices, the noise maker body of the invention is easily created by injection molding process, which provides inherent quality control for size and configuration Thus, the component provides substantial savings in manufacturing steps and labor and is economical to manufacture.

In one aspect, the present invention provides a noise making device having an injection molded single piece body, a membrane and a retaining ring. The injection molded single piece body includes a central tube and a pressure tube.

The pressure tube has a pressure tube first end and pressure tube second end. It is disposed within the central tube to define a sound chamber. The second end of the pressure tube tapers radially outward to define a tapered bottom. Due to being a single piece, it is connected to and integral with the interior wall of the central tube. A pressure chamber is defined between the pressure tube and the central tube.

The central tube has a central tube first end and a central tube second end. Further, the central tube defines a sound hole such that air or other gas may be forced into said pressure chamber.

The membrane extends over the central tube first end and the pressure tube first end, and is made from thin material, such as but not limited to cellophane. The retaining ring has an inner diameter adapted to fit over the outer surface of said pressure tube such that the membrane is secured to and stretched across the central tube first end and the pressure tube first end.

Sound is created when air or other gas is forced into pressure chamber. The air must pass through the pressure chamber around central tube first end and out the discharge end of the sound extension end. By forcing air through the sound hole and into the pressure chamber, membrane vibrates producing a loud sound.

Another aspect of the present invention provides for the noise making device of the present invention where the axial length of the pressure chamber is less than the axial length of the sound chamber. This allows for pressure to build up more quickly in the pressure chamber so that the vibration of the membrane can occur more easily.

Another aspect of the present invention provides for the noise making device set out above where the central tube first end lies in generally same plane as the pressure tube first end.

In yet another aspect of the present invention, the noise making device set out above where the central tube first end lies in a first plane and the pressure tube first end lies in a second plane is disclosed. The distance between the first plane and the second plane is defined by a setback, which can range from between 0.01 mm and 0.5 mm, with 0.18 mm preferably.

To adjust the pitch of the sound of the present invention, extenders can be attached to the discharge end of said sound extension tube.

Further features of the present invention will be apparent to those skilled in the art upon reference to the accompanying drawings and upon reading the following description of the preferred embodiments.

DETAILED DESCRIPTION OF THE PREFERRED EMBODIMENTS

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

Figure 1:
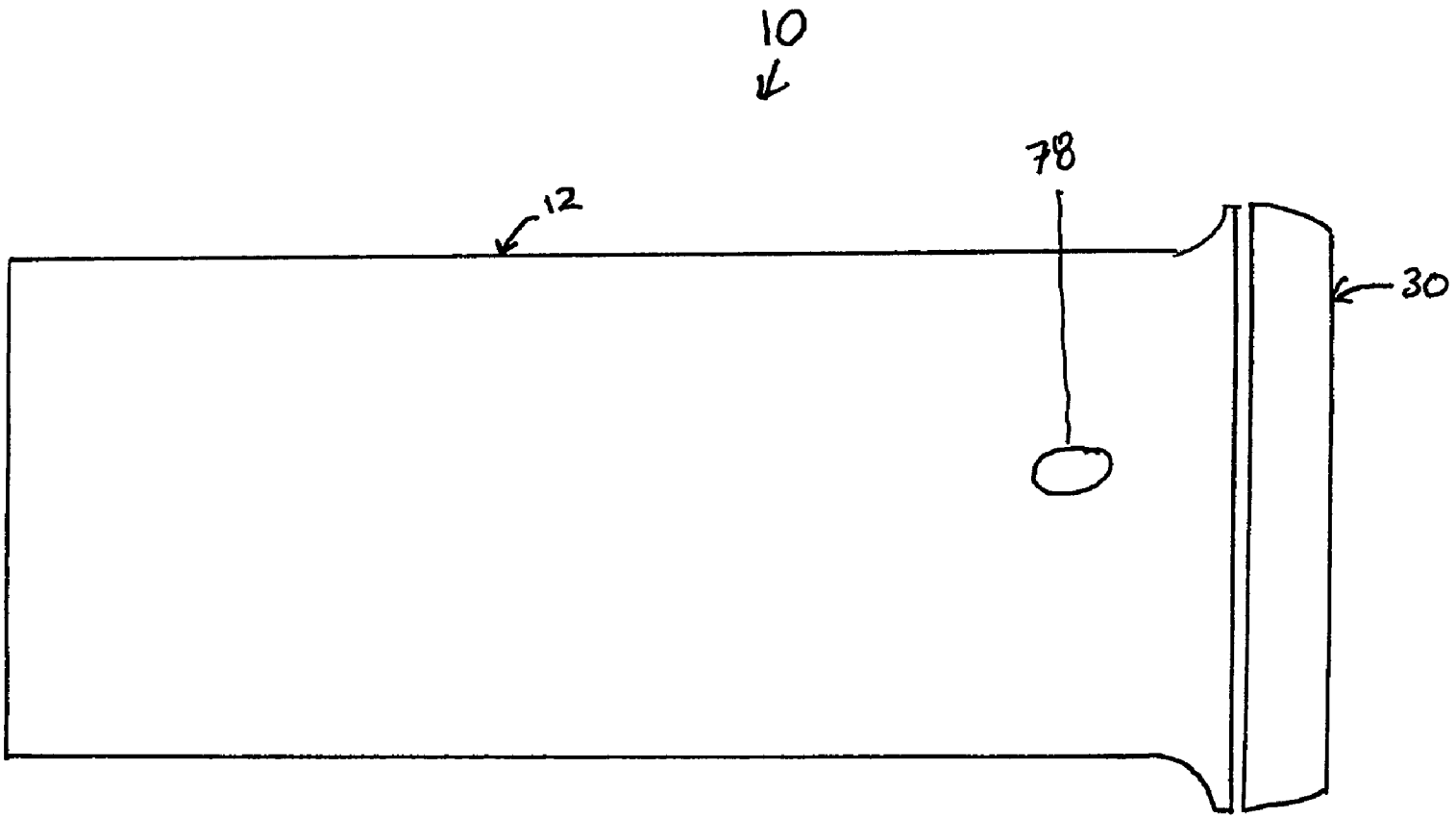
FIG. 1 is a perspective side view of an embodiment of the present invention.
Figure 2:
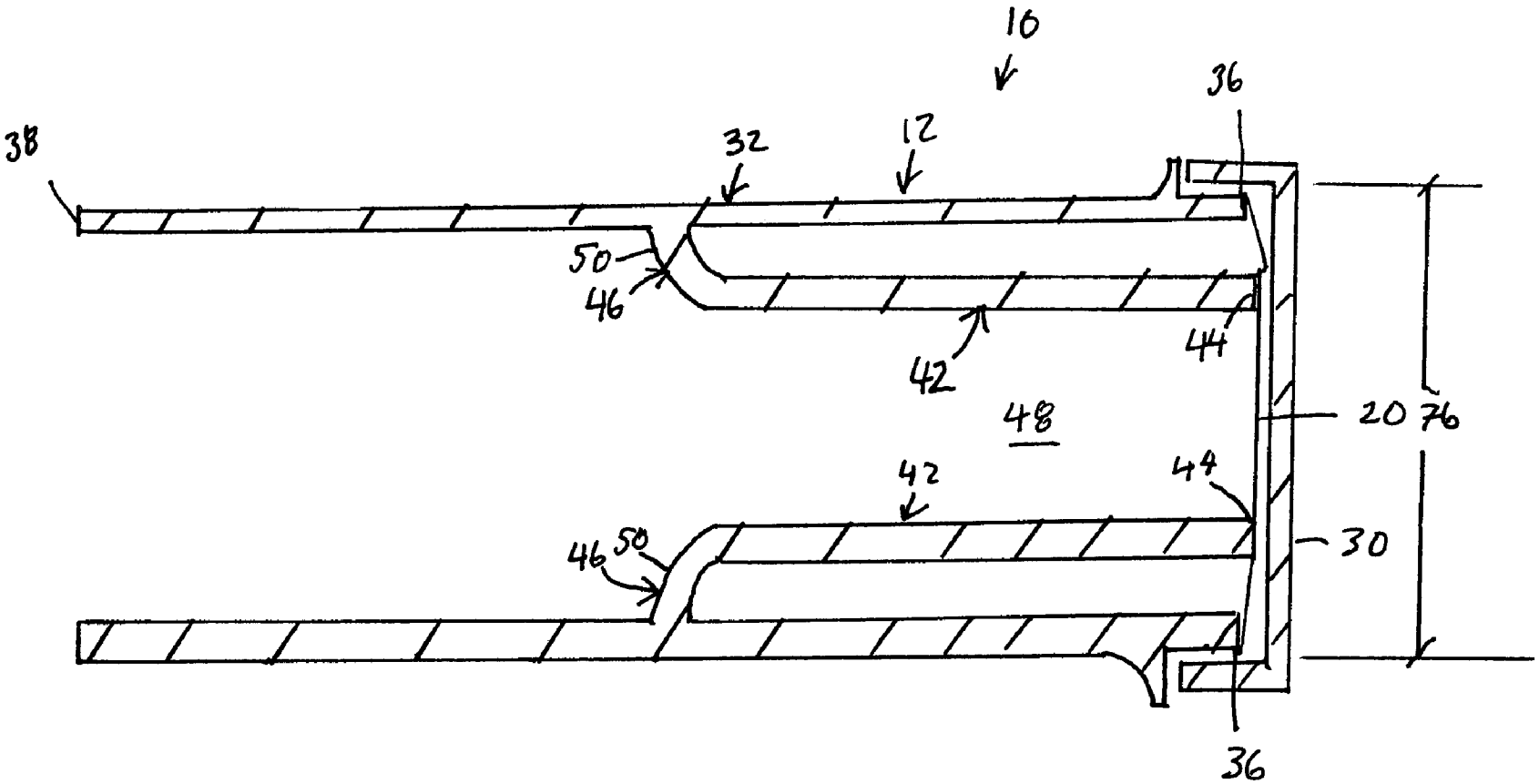
FIG. 2 is a cross-sectional side view of the embodiment of FIG. 1.
Figure 3:
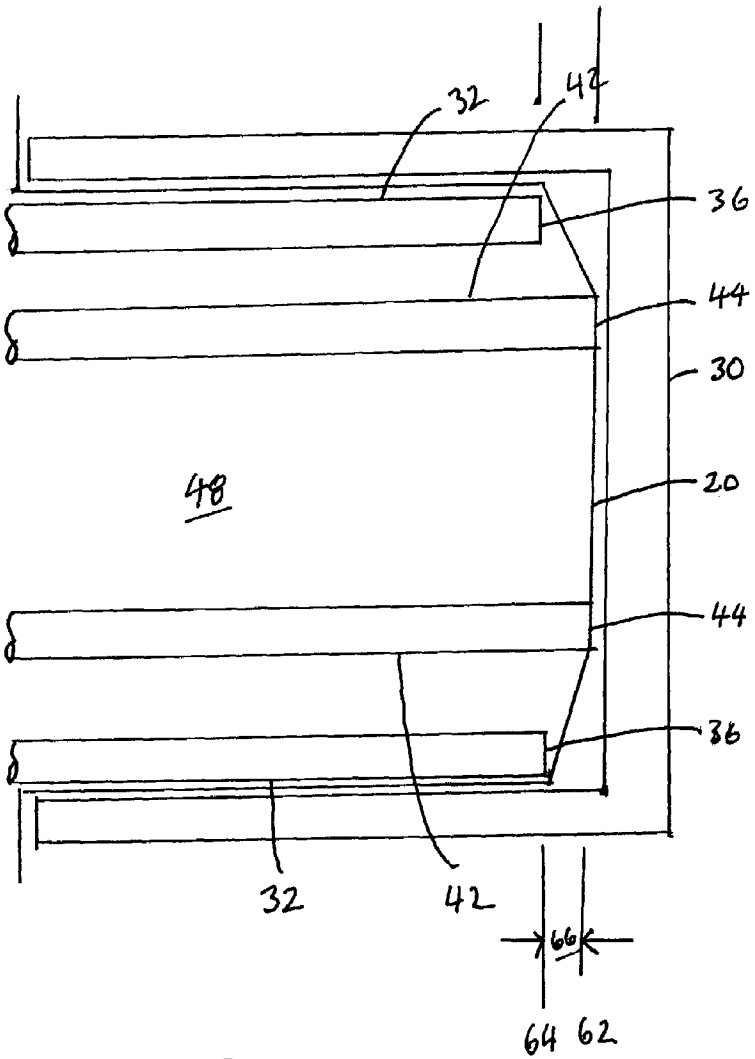
FIG. 3 is a cross-sectional side view of the embodiment of FIG. 1 showing an embodiment of the pressure tube first end and central tube first end of the present invention.

As shown in FIGS. 1–3, an embodiment 10 of the inventive noise making device is disclosed. The embodiment 10 comprises a single injection molded structural body 12, a membrane 20 and a retaining ring 30. The injection molded single piece body 12 includes a central tube 32 and a pressure tube 42. In this embodiment, the central tube 32 and pressure tube 42 are shown in FIG 2. as being generally cylindrical. This is for illustrative purposes and is not meant to be limiting. By utilizing an injection molding process, the creation of the single piece body 12 is created in a more efficient and cost effective manner than other prior art noise makers. Further, by utilizing an injection molding process, the outer shape of the single piece body 12 can be created in a variety of shapes, including but not limited to a soda bottle or a ball shape.

The pressure tube 42 has a pressure tube first end 44 and pressure tube second end 46 and being disposed within central tube 32 to define a sound chamber 48. Pressure tube second end 46 tapers radially outward to define a tapered bottom 50. The tapered bottom 50 is connected to and integral with the interior wall of central tube 32 defining a pressure chamber between pressure tube 42 and central tube 32.

The central tube 32 has a central tube first end 36 and a central tube second end 38. Further, central tube 32 has a sound hole 78 such that air or other gas may be forced into pressure chamber 48.

The membrane 20 extends over the central tube first end 36 and the pressure tube first end 44, and is made from thin material, such as but not limited to cellophane. The retaining ring 30 has an inner diameter 76 adapted to fit over the central tube first end 36 such that the membrane 20 is secured to and stretched across the central tube first end 36 and the pressure tube first end 44.

Sound is created when air or other gas is forced into pressure chamber 48. The air must pass through the pressure chamber 48 around pressure tube first end 36 and out central tube second end 38. By forcing air through sound hole 78 and into the pressure chamber 48, membrane 20 vibrates producing a loud sound.

Another aspect of the present invention provides for the noise making device set out above where the central tube first end 36 lies in generally same plane as the pressure tube first end 44.

In yet another aspect of the present invention, as shown in FIG. 3, the noise making device set out above where the central tube first end 36 lies in a first plane 64 and the pressure tube first end 44 lies in a second plane 62 is disclosed. The distance between the first plane 64 and the second plane 62 is defined by a setback 66, which can range from between 0.01 mm and 0.5 mm, with 0.18 mm preferably.

Figure 4:
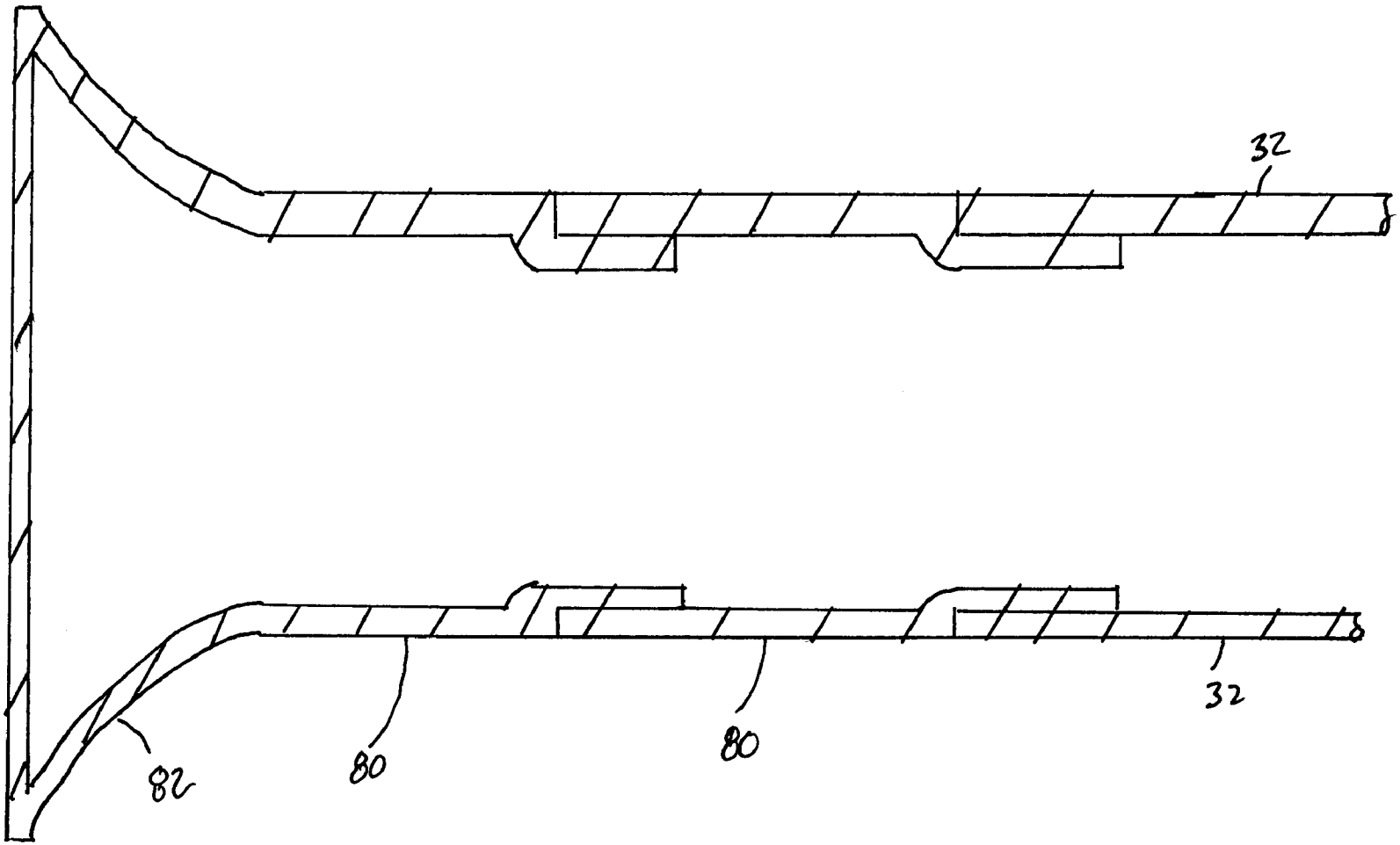
FIG. 4 is a cross-sectional side view an embodiment of the central tube second end of the present invention having an embodiment of an extender attached thereto.

To adjust the pitch of the sound of the present invention, extenders 80 can be attached to the central tube second end 38. As shown in FIG. 4, an embodiment of extenders 80 can have a flared end 82 to further modify the sound emitted therefrom.

While the invention has been described with a certain degree of particularity, it is understood that the invention is not limited to the embodiments set forth herein for purposes of exemplification, but is to be limited only by the scope of the attached claims or including the full range of equivalency to which each element thereof is entitled.

What is claimed is:

1. A noise maker comprising:

an injection molded single piece body including a central tube and a pressure tube, said central tube having an interior wall and an outer surface and further having a central tube first end, a central tube second end, said pressure tube having a pressure tube first end and pressure tube second end and being disposed within said central tube to define a sound chamber, said pressure tube second end tapers radially outward to define a tapered bottom, said tapered bottom being connected to and integral with said interior wall of said central tube defining a pressure chamber between said pressure tube and said central tube said central tube further having a sound hole such that air or other gas may be forced into said pressure chamber, said central tube first end and said central tube second end;

a membrane extending over said central tube first end and said pressure tube first end; and a retaining ring having an inner diameter adapted to fit over said central tube first end of said central tube whereby said membrane is in contact with said central tube first end and said pressure tube first end.

2. The noise maker of claim 1 wherein said central tube first end lies in generally same plane as said pressure tube first end.

3. The noise maker of claim 1 wherein said central tube first end lies in a first plane and said pressure tube first end lies in a second plane, the distance between said first plane and said second plane defines a setback.

4. The noise maker of claim 3 wherein said setback ranges between 0.01 mm and 0.2 mm.

5. The noise maker of claim 1 further comprising one or more extenders removably connected to said central tube second end.

6. The noise maker of claim 1 wherein the axial length of said pressure chamber is less than the axial length of said sound chamber.

7. The noise maker of claim 1 wherein said membrane is made from cellophane.

8. The noise maker of claim 1 wherein said central tube is defined as being generally cylindrical.

9. The noise maker of claim 1 wherein said central tube is defined as being generally bottle shaped.

10. The noise maker of claim 1 wherein said central tube is defined as being generally ball shaped.

11. The noise maker of claim 1 wherein said pressure tube is defined as being generally cylindrical.

12. The noise maker of claim 1 further comprising at least one extender having a first extender end inserted in said central tube second end and a second extender end for discharging sound or for receiving the first extender end of an additional extender.

13. The noise maker of claim 12 wherein said second extender end is generally defined as being flared.

14. A method for creating a noise maker comprising the steps of:

creating by an injection molding process a single piece body including a central tube and a pressure tube, said central tube having an interior wall and an outer surface and further having a central tube first end, a central tube second end, said pressure tube having a pressure tube first end and pressure tube second end and being disposed within said central tube to define a sound chamber, said pressure tube second end tapers radially outward to define a tapered bottom, said tapered bottom being connected to and integral with said interior wall of said central tube defining a pressure chamber between said pressure tube and said central tube said central tube further having a sound hole such that air or other gas may be forced into said pressure chamber, said central tube first end and said central tube second end;

extending a membrane over said central tube first end and said pressure tube first end; and securing a retaining ring to said central tube, said retaining ring having an inner diameter adapted to fit over said central tube first end of said central tube whereby said membrane is in contact with said central tube first end and said pressure tube first end.

* * * * *